United States Patent [19]

Russo et al.

[11] Patent Number: 4,569,180

[45] Date of Patent: Feb. 11, 1986

[54] SYSTEM FOR REVERSING THE SEQUENTIAL POSITION OF THE OPERATIVE UNITS IN AUTOMATIC PACKAGING MACHINERY

[76] Inventors: Luigi Russo, Lotto 2B Casa CF - I 21040 Venegono Superiore, Province of Varese; Vincenzo Marzaroli, 9, Via Verbania - I 20021 Ospiate di Bollate, Province of Milan, both of Italy

[21] Appl. No.: 585,780

[22] Filed: Mar. 2, 1984

[51] Int. Cl.[4] ..... B65B 65/02

[52] U.S. Cl. ..... 53/201; 493/478

[58] Field of Search ..... 53/201, 202, 168, 167; 493/477, 478, 479, 480

[56] References Cited

U.S. PATENT DOCUMENTS

| | | | |
|---|---|---|---|
| 3,054,236 | 9/1962 | Stroop | 53/201 X |
| 3,243,033 | 3/1966 | Merchant et al. | 53/201 X |
| 3,282,021 | 11/1966 | Hartman | 53/201 |
| 3,514,922 | 6/1970 | Cravens et al. | 53/201 X |
| 4,077,441 | 3/1978 | Rosen et al. | 53/201 X |

*Primary Examiner*—James F. Coan

*Attorney, Agent, or Firm*—Steele, Gould & Fried

[57] ABSTRACT

A system adapted to reverse the sequential position of the operative units of packaging machinery as a function of the orientation of the processing line and the floor space where the plant is located. The system provides for the use of a coupling plate disposed between the work table and the machine housing, the plate being adapted to be mounted in two specularly symmetrical rotational positions 180 degrees apart relative to one another and with respect of the machine housing.

4 Claims, 5 Drawing Figures

SYSTEM FOR REVERSING THE SEQUENTIAL POSITION OF THE OPERATIVE UNITS IN AUTOMATIC PACKAGING MACHINERY

BACKGROUND OF THE INVENTION

The present invention relates to a system allowing reversal of the sequential arrangement of the operative groups or units of a packaging machinery so as to be more easily fitted in the space available. More particularly, the system enhances adaptation and arrangement of the machinery as a function of the processing line, loading ease and maintenance.

It is well known that most machinery and equipment for carrying out the packaging operations in food processing lines, are provided with conveyor tables. The conveyor tables are mechanically connected to a control frame, in which the driving unit and the electromechanical or electronic automation unit for programming the operative cycle are arranged.

These tables are generally large and the user has to order the machinery taking into account available floor space, with having regard to the table position and whether the workpieces are to be fed from the right side or the left side relative to the control board.

Machinery manufacturers are therefore obliged to make two sets of castings, one to accommodate right hand machines and another to accommodate left hand machines. This raises costs and prevents rationalization of series production, two sets of castings being indispensable because the base structure and the working heads must be arranged according to the right or left orientation of the conveyor.

SUMMARY OF THE INVENTION

The present invention solves this problem and allows assembly of the conveyor table and the operative groups in both loading directions. Moreover, this invention enables the orientation to be changed subsequently, as needed, by means of the novel technical measures described herein.

This problem is solved by mounting a detachable, rotatably reversable metal coupling plate between the machine frame and the conveyor. The coupling plate has operative groups of mounting holes at two opposite positions, separated by 180 degrees. The coupling plate can be reversed, that is, rotated 180°, without modifying the driving unit and the electromechanical or electronic control unit.

The coupling plate is provided with two sets of through holes in which the operative groups or units can be detachably mounted for right or left hand orientation, depending upon the position of the coupling plate. The sets of holes are specularly symmetrical, that is, a mirror image of one another.

BRIEF DESCRIPTION OF THE DRAWINGS

This system may be realized in several embodiments, all falling within the scope of the invention. The system will be described in some detail with regard to a non limiting illustrative example of the invention, reference being had to the accompanying drawings, in which.

DETAILED DESCRIPTION OF THE PREFERRED EMBODIMENT

Figure 1:
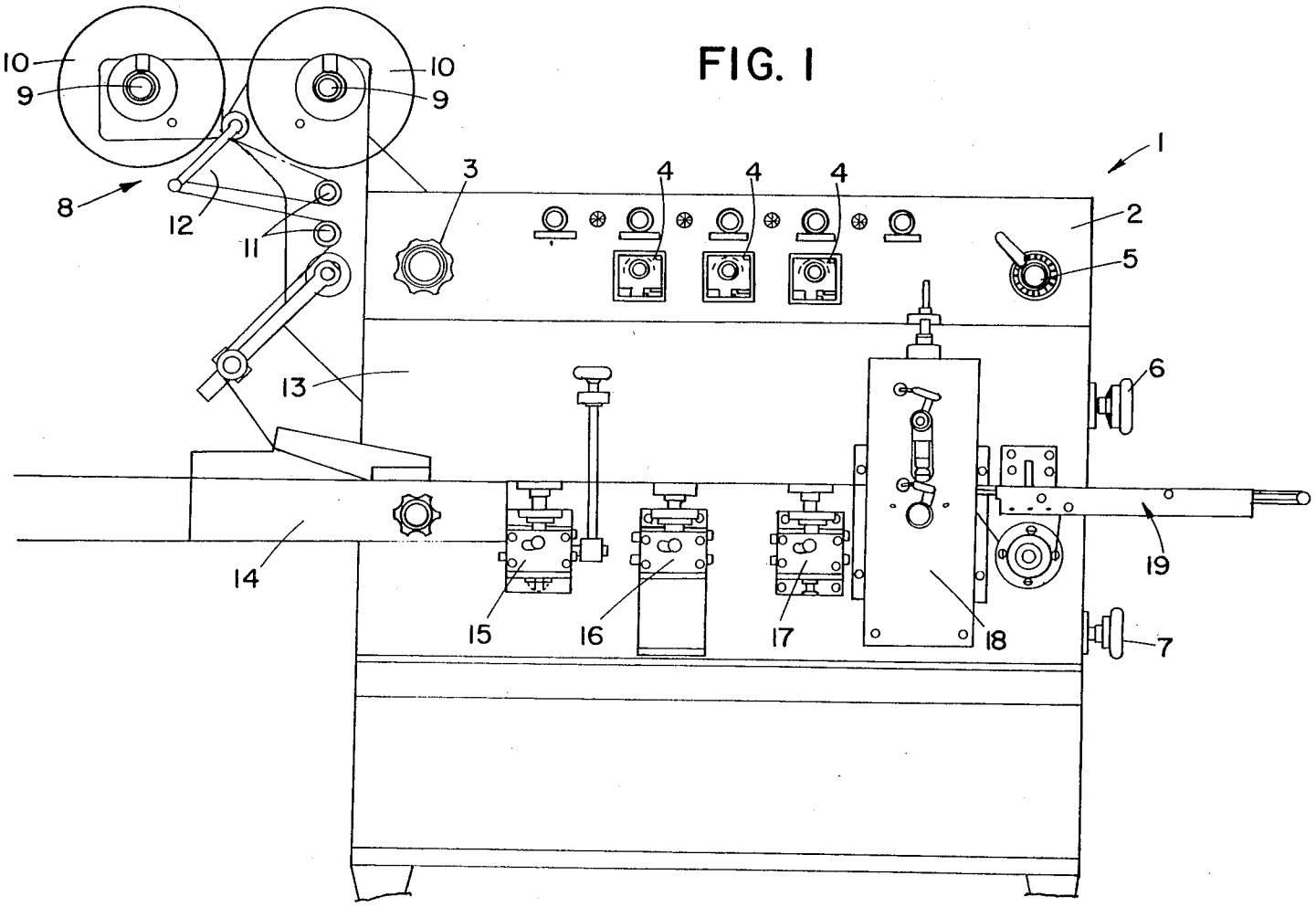
FIG. 1 is a front view of a packaging machine.
Figure 2:
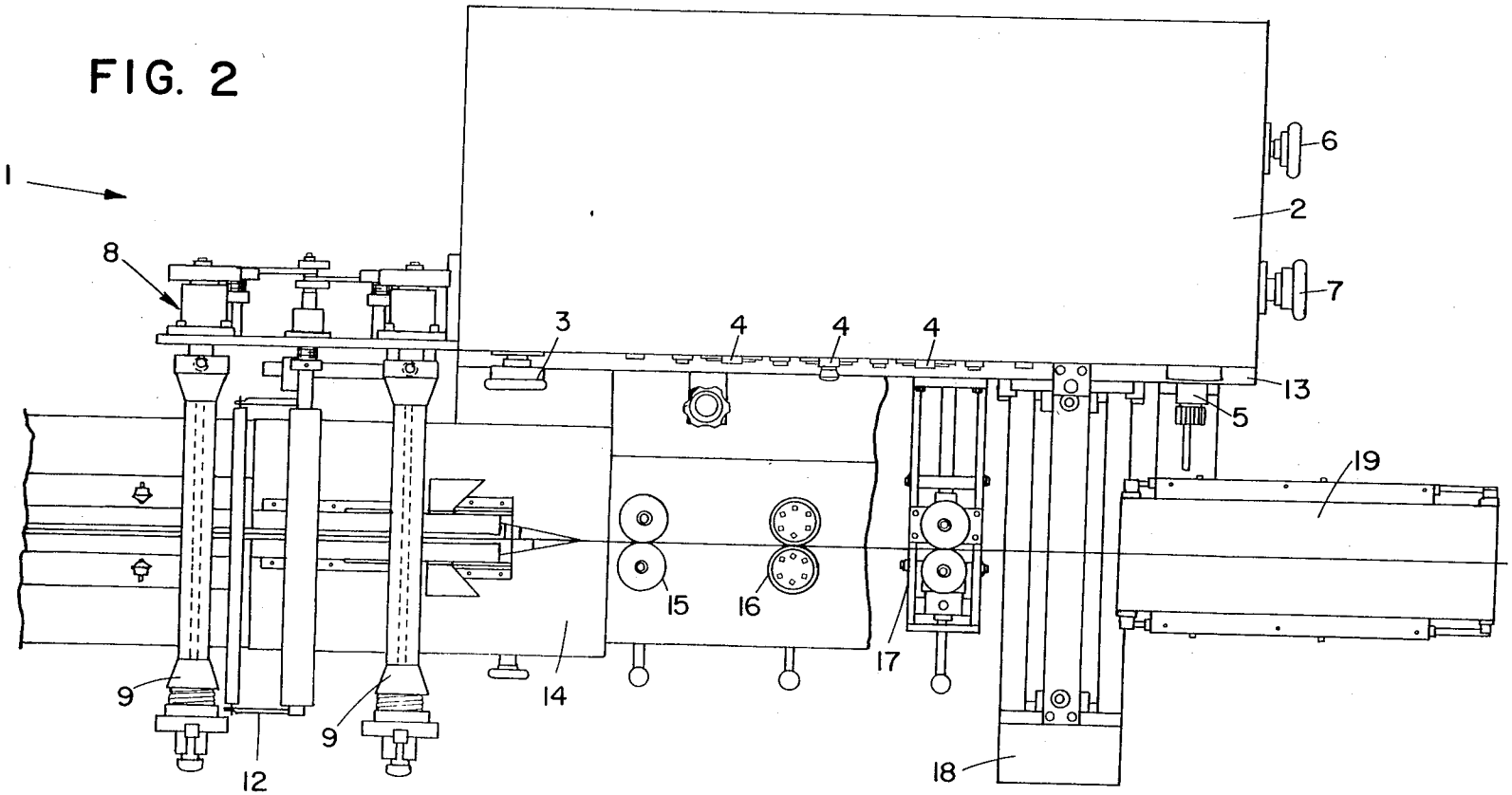
FIG. 2 is a plan view of the packaging machinery with the conveyor table assembled in a left hand orientation.

With reference at first to FIGS. 1 and 2 of the drawings, the packaging machinery 1 according to the present invention has a housing or case 2 containing the entire driving unit and the electromechanical units for programming the operations to be effected in the desired sequence. These units comprise a handwheel 3 for adjusting the package length, apparatus 4 for regulating the heating temperature in order to effect the package welding, a knob 5 for calibrating the photoelectric cell controlling the sequential operation of the units and two lateral handwheels 6,7. The first handwheel 6 regulates the cutting and welding step and the second handwheel 7 adjusts the release step. On one side of the housing 2 there is the assembly 8 for feeding the packaging material, comprising two supports 9 for the rolls 10 of packaging web, of which the one is operative and the other is in a stand-by position, several guide rollers 11 and the brake and clutch equalizer 12 to keep a proper tension of the web.

A mechanical coupling plate 13 is detachably mounted on, the housing 2. A table 14 for conveying the workpieces to be packaged, a unit 15 for picking up and entraining the package lower edges, a heating unit 16 for effecting the longitudinal continuous welding, another set of guide rollers 17, a unit 18 for effecting transversal welding and severing the individual packages, and finally, a conveyor belt for picking up and discharging the finished packages are all indirectly mounted on the housing by attachment to the coupling plate 13, in either of two sets of holes.

As it is clear, the whole assembly of the units and table have large dimensions and the presently used technique consists in usually making, very often by separately casting, all of the required supports and working heads having different hole patterns according to the assembly orientation of the machinery, thus needing two complete sets of members, one for each orientation.

Figure 3:
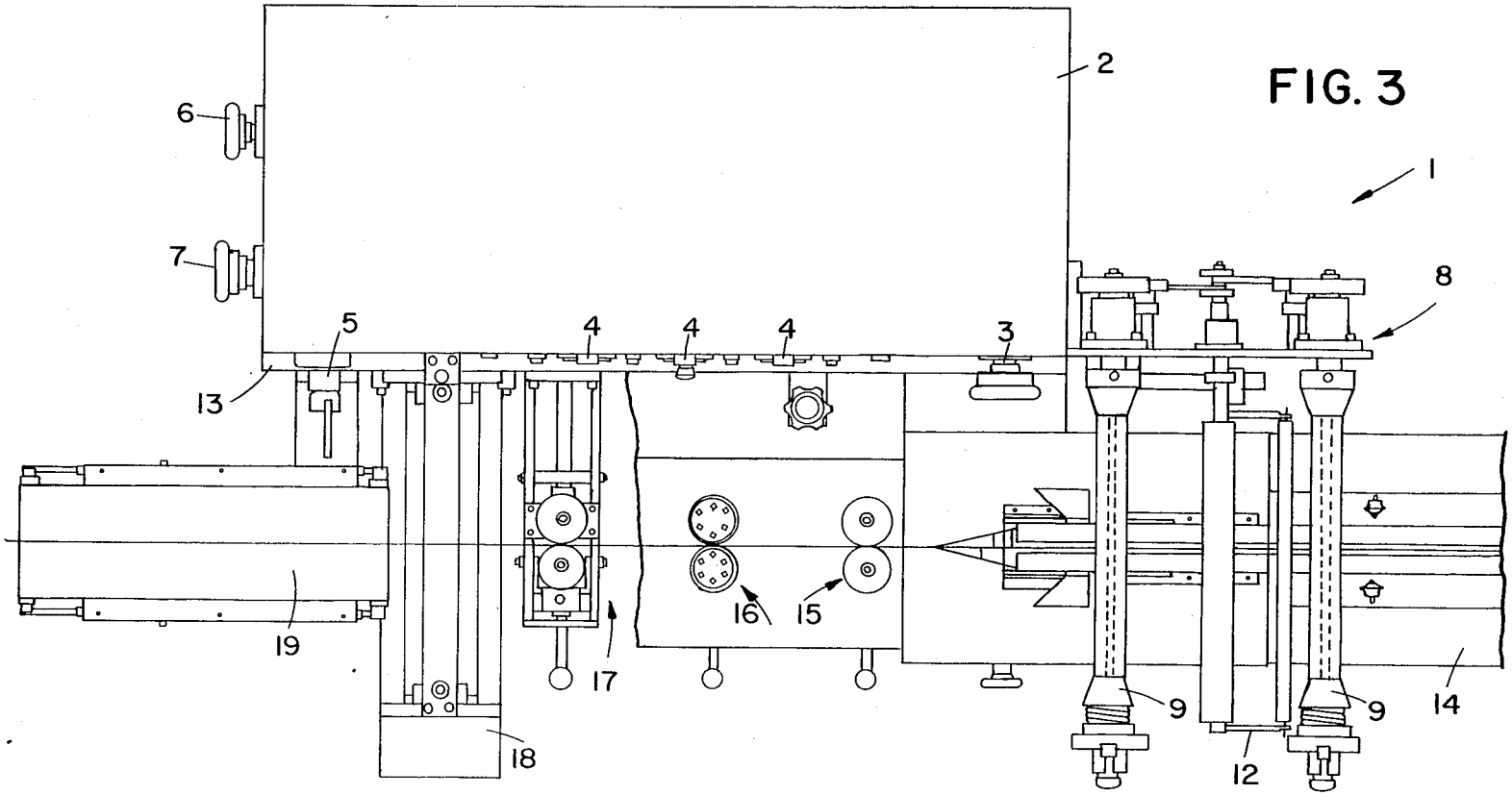
FIG. 3 is a plan view of the same packaging machinery, but with the conveyor table assembled in a right hand orientation.

With reference now to FIG. 3, by means of the present invention it is possible to assemble all the above mentioned components in either order, that is in a specularly symmetrical arrangement so as to obtain right hand fed machinery (FIG. 4) or left hand fed machinery (FIG. 1).

Figure 4:
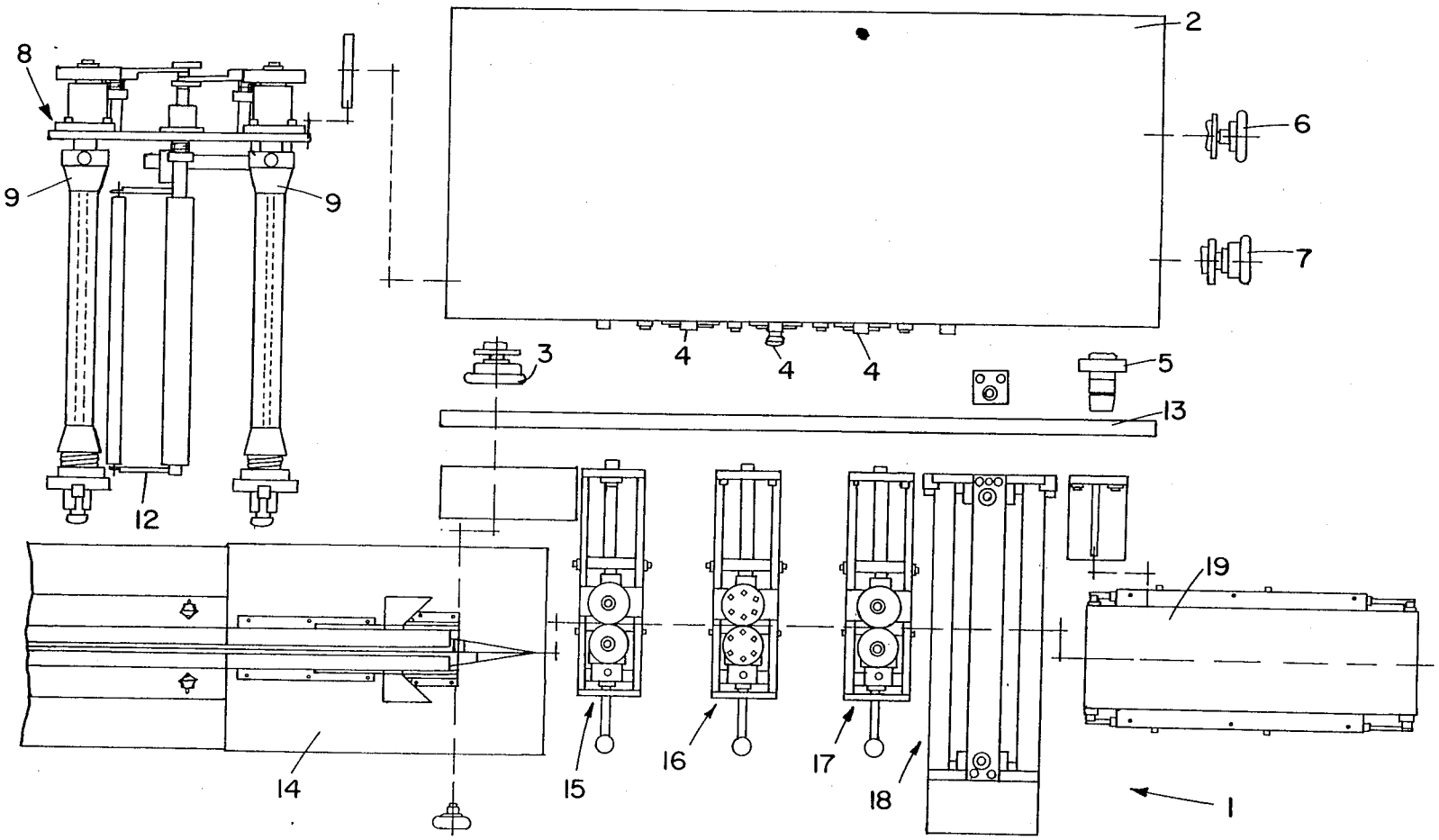
FIG. 4 is an exploded top view of the packaging machinery provided with the left hand conveyor table; and, FIG. 5 is a side view of the packaging machinery.

Referring now to FIG. 4, in order to obtain the benefits of this inventions, the coupling plate 13 is mounted to the housing 2 in either of the desired rotational positions, each of the positions providing all the holes needed for the attachment of the operative units, arranged in a symmetrical order. It is thereby possible to mount the same units in both specularly symmetrical or sequentially reversed positions.

Merely for a control need, on the housing 2 only the handwheel 3 for regulating the package is inserted, as said handwheel 3 must always be coupled with the relevant assembly 8 bear the rolls 10, which is obviously mounted on the same side of the conveyor table 14, and consequently also the cell calibration knob 5.

Figure 5:
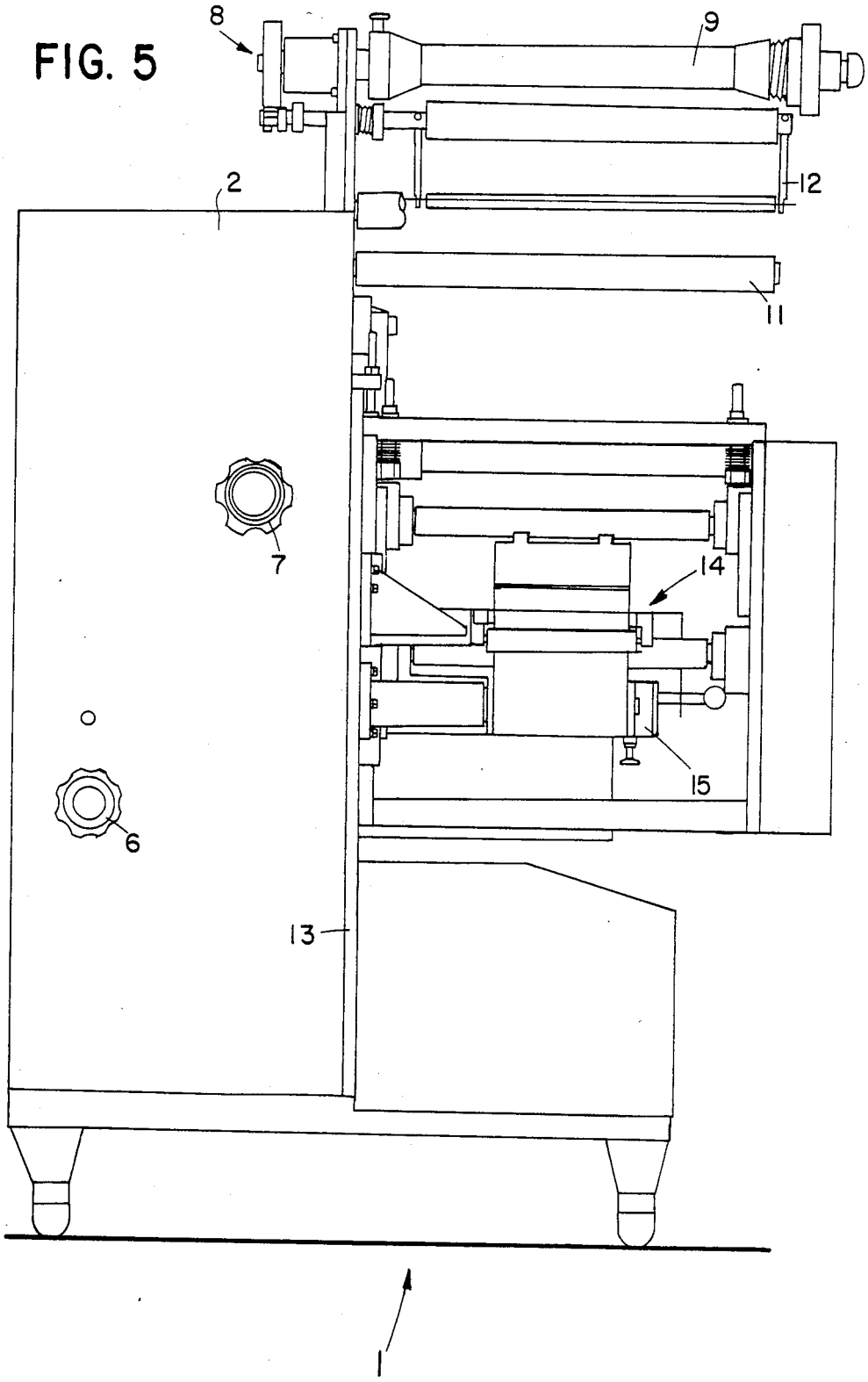

With reference to FIG. 5, the packaging machinery 1, when seen from the side, has all the units of the processing line mounted overhanging from the coupling plate 13, the coupling plate 13 being fixed to the housing 2. It is clear that when plate 13 is turned 180 degrees, nothing is modified or added and only assembling and disassembling operations are needed to obtain a right-hand or left-hand fed machinery, due to the symmetrical sets of through holes of the plate 13.

The system may be embodied in many other specific forms without departing from the spirit or essential attributes thereof. Accordingly, reference should be made to the appended claims rather than the foregoing specification, to ascertain the scope of the invention.

What is claimed is:

1. A system for reversing the sequential position of operative units and conveyor tables in automatic packaging machinery, the machinery having a housing for driving and control units for the operative units and conveyor tables, the system comprising a coupling plate detachably mountable on the machinery housing in two rotational positions 180° from one another, the coupling plate having a set of mounting holes corresponding to each rotational position which are specularly symmetrical with respect to one another, the operative units and the conveyor tables being detachably mountable on the coupling plate in either set of symmetrical holes, whereby the operative units and the conveyor tables may be mounted for right-hand and left-hand feeding and processing, depending upon the rotational position of the mounting plate, without replacing or adding mechanical components to the packaging machinery.

2. A system according to claim 1, wherein the driving and control units arranged inside the machinery housing are fixed in position, thereby obviating the need for modification thereof depending upon right-hand or left-hand orientation of the operative units and conveyor tables.

3. A system according to claim 1, further comprising a web roll bearing assembly detachably mounted directly to the machinery housing, the web roll bearing assembly being the only operative unit not mounted on the coupling plate, the web roll bearing assembly being mountable on opposite sides of the machinery housing depending upon the right-hand or left-hand orientation of the operative units and the conveyor tables.

4. A system according to claim 2, further comprising a web roll bearing assembly detachably mounted directly to the machinery housing, the web roll bearing assembly being the only operative unit not mounted on the coupling plate, the web roll bearing assembly being mountable on opposite sides of the machinery housing depending upon the right-hand or left-hand orientation of the operative units and the conveyor tables.

* * * * *